United States Patent [19]

Stalder

[11] 4,176,514

[45] Dec. 4, 1979

[54] METHOD OF CONTROLLING THE OPERATING CONDITIONS OF A RING SPINNING MACHINE AND APPARATUS FOR IMPLEMENTING THE METHOD

[75] Inventor: Herbert Stalder, Kollbrunn, Switzerland

[73] Assignee: Rieter Machine Works Ltd., Winterthur, Switzerland

[21] Appl. No.: 899,220

[22] Filed: Apr. 24, 1978

[30] Foreign Application Priority Data

May 11, 1977 [CH] Switzerland ..... 5882/77

[51] Int. Cl.[2] ..... D01H 15/00; D01H 11/00; D01H 13/16

[52] U.S. Cl. ..... 57/261; 57/83; 57/264; 57/304

[58] Field of Search ..... 57/34 R, 34.5, 75, 56, 57/156, 80, 83–87, 261, 262, 264, 265, 300, 304, 305

[56] References Cited

U.S. PATENT DOCUMENTS 3,950,925 4/1976 Igel ..... 57/34 R

FOREIGN PATENT DOCUMENTS 1366770 6/1964 France ..... 57/34.5
652311 4/1951 United Kingdom ..... 57/34.5

*Primary Examiner*—John Petrakes
*Attorney, Agent, or Firm*—Werner W. Kleeman

[57] ABSTRACT

A method of, and apparatus for, consecutively controlling the operating conditions at a plurality of spinning positions or locations of a ring spinning machine, wherein there are detected yarn breakages and lap-up formations on rolls of the drafting arrangements. Upon detection of a yarn breakage at a predetermined spinning position the suction air stream of the suction system at such spinning position is rendered ineffectual at such spinning position of the ring spinning machine and such spinning position is checked for the presence of a fiber stream.

16 Claims, 7 Drawing Figures

METHOD OF CONTROLLING THE OPERATING CONDITIONS OF A RING SPINNING MACHINE AND APPARATUS FOR IMPLEMENTING THE METHOD

BACKGROUND OF THE INVENTION

The present invention relates to a new and improved method of, and apparatus for, controlling the operating conditions prevailing at a ring spinning machine, by means of a control or monitoring apparatus which travels from spinning position to spinning position, there being consecutively checked at each spinning position the presence of a yarn or thread which is being formed thereat and for the absence of fiber lap-ups on at least one of both delivery rolls of the drafting arrangements.

A ring spinning machine for the final spinning process of a yarn or thread—hereinafter conveniently usually referred to as simply a yarn—consists of a large number of spinning positions, as a rule exceeding 400 spinning positions. Each spinning position is provided with a drafting arrangement where the infed fiber material, also referred to commonly in the art as roving, is drafted to the final yarn fineness or count and subsequently is spun into a yarn. Twist is imparted to the spun yarn and the same is wound by means of a spindle and ring arrangement.

Notwithstanding continuous efforts it has heretofore not been possible to avoid the occurrence of end or yarn breakages at a spinning position between the drafting arrangement and the spindle. This relatively rare event, however, is extremely troublesome since it involves both production losses and additional expenditure in work. Furthermore, there is brought about losses of material inasmuch as the loose fibers, which continue to emerge from the pair of delivery rolls of the drafting arrangement, are on longer caught by the twist of the formed yarn but infed by means of a suction nozzle of a yarn suction device to a collector or collecting device.

It happens now and again that such loose fibers, instead of moving into the suction nozzle, lap-up on one or both delivery rolls. This fiber lap-up increases in size as long as the supply of fibers is not interrupted, or as long as the yarn forming process is not reestablished. Failure to interrupt such undesirable lap-up formation ultimately will result in damage to the drafting arrangement of the involved spinning position or location. Therefore, in the spinning plant the operating personnel must continuously control and monitor the operating conditions of the ring spinning machine. The broken yarn ends must be pieced-up, and any possible fiber lap-ups formed on the rolls must be previously eliminated.

In more recent times there have become known to the art equipment which attempts to replace the work of the operating personnel at the ring spinning machine by automation through the use of operating or servicing or control devices which perform two tasks:

(a) Scanning the operating conditions at the spinning position, i.e., detecting the formation of yarn, the presence of a fiber lap-up on the rolls of the drafting arrangement, or entry of the roving at the drafting arrangement and so forth.

(b) Performing an actual operating or servicing operation at the spinning location or position, such as, for instance, re-piecing the broken yarn, stopping the supply of material to the drafting arrangement and so forth.

These operations are performed as a function of the detected operating or working conditions at the relevant spinning position or location.

In the first instance the present invention is concerned with the detection or recognition of certain working or operating conditions at the spinning position. Various solutions, intended to perform this objective, have already been proposed in the art.

Thus, for instance in Swiss Patent No. 571,588 and the cognate U.S. Pat. No. 3,950,925 and German Patent Publication No. 2,339,654, there is disclosed a proposal for automatically piecing-up yarns on ring spinning machines by using a scanning device which simultaneously detects both the absence of the yarn and any lap-up on the delivery rolls. With this equipment a light source is directed at the path of travel of the strand of fibers emerging from the delivery rolls and which are not spun into a yarn. The fiber strand reflects the light beam onto a photocell. With this proposal there is exploited the fact that the path of travel of the spun-in strand of fibers, i.e. the yarn which is being formed, does not coincide with the path of travel of the strand which is not spun-in and which is sucked into the suction device of the ring spinning machine.

The detecting device is mounted upon a travelling control device. This equipment is associated with the drawback that there is needed an extremely precise guiding of the control device along the ring spinning machine, since the spacing between the prior mentioned respective paths of travel of the strands of fibers is extremely small. Such requisite precise guide devices are associated with high equipment expenditure, without which the control device cannot satisfactorily perform.

According to a second proposal the strand of fibers emerging from the delivery rolls is sucked-off and there is activated a sensor in the suction duct. However, the use of this equipment is limited to a non-travelling control device coordinated to individual spinning positions, and, thus, cannot be employed for control devices which migrate from spinning position to spinning position.

Moreover, from Swiss Patent No. 578,058 and the corresponding U.S. Pat. No. 4,030,281 there is known to the art a control device for an automatic yarn piecing device for ring spinning machines, which, among other features, contains mechanism for detecting the fiber lap-ups on the delivery rolls of the drafting arrangement. This mechanism comprises two rolls provided with axial openings. These rolls are mounted at the immediate vicinity of the delivery rolls. Now, if a fiber lap-up develops on a delivery roll, then the roll is set into rotation owing to contact of the lap-up with the roll, and such is detected for each roll by means of a light beam and a photocell. Instead of using an optical control system there is also proposed a contact tongue for the lower, metallic delivery roll.

Mechanical scanning of the delivery roll is associated with the drawback that there is here also required an extremely precise and expensive guiding of the control device along the machine. This structure equally is of relatively complicated design, thereby detrimentally influencing its price and operational reliability.

SUMMARY OF THE INVENTION

Hence, with the foregoing in mind, it is a primary object of the present invention to provide an improved method of, and apparatus for controlling the operating conditions of a ring spinning machine in a manner not associated with the aforementioned drawbacks and limitations of the prior art proposals.

Another and more specific object of the present invention aims at eliminating the disadvantages of the prior art equipment for detecting certain operating conditions at the ring spinning positions of a spinning machine, and specifically proposes a method and control or monitoring apparatus wherein in a simple and inexpensive manner there can be dispensed with the need for any precise guiding of the equipment, without impairing the operational reliability thereof.

Still a further significant object of the present invention aims at providing a new and improved method of, and apparatus for, controlling the operating conditions of a ring spinning machine, with the use of relatively simple, inexpensive and highly reliable equipment, avoiding the need for the complicated and precise guiding structure and the associated drawbacks which prevail with prior art equipment as discussed above.

Yet a further significant object of the present invention is directed to a new and improved construction of apparatus for controlling the operating conditions of a ring spinning machine in an extremely reliable and accurate manner, but which apparatus is relatively simple in construction and design, reasonably economical to fabricate, does not require any complicated maintenance and servicing work, and is not readily subject to breakdown or malfuction.

Now in order to implement these and still further objects of the invention, which will become more readily apparent as the description proceeds, the method aspects of the present invention are manifested by the features that for the purpose of consecutively controlling or monitoring the operating conditions at a plurality of spinning positions or locations of a spinning machine, there are detected yarn breakages and lap-up formations on the rolls of the drafting arrangement. Upon detection of a yarn breakage at a predetermined spinning position there is rendered ineffectual at such spinning position the suction air stream from the suction system of the ring spinning machine and such predetermined spinning position is checked for the presence of a fiber stream.

As already alluded to above, the invention is not only concerned with the aforementioned method aspects, but also involves control or monitoring apparatus for implementation of such method. Now the control apparatus, for the performance of the method taught by the invention, and which travels from spinning position to spinning position along a ring spinning machine equipped with a suction device provided at each spinning position, is manifested by the features that there is provided a yarn detector which controls the presence of the yarn between the delivery rolls of the drafting arrangement and the spindle. Also, there is provided a fiber stream-deflecting device which, in the event of yarn breakage and in response to its activation by the yarn detector, takes-up the fiber stream which is carried or entrained by the suction air stream of the suction system and transfers such to a fiber detector.

According to a preferred embodiment of the control apparatus of the present invention, the fiber stream-deflecting device embodies a suction nozzle whose suction action upon the fiber stream exceeds the action of the suction nozzle of the yarn suction device at the spinning position.

Furthermore, the fiber detector can be constructed in the form of a light barrier which is responsive to the presence of loose fibers in an air stream, and also can be designed in the form of a collecting shield or grid for loose fibers, the air resistance of which in the presence of a fiber stream increases and, in turn, initiates a switching operation.

BRIEF DESCRIPTION OF THE DRAWINGS

The invention will be better understood and objects other than those set forth above, will become apparent when consideration is given to the following detailed description thereof. Such description makes reference to the annexed drawings wherein.

Figure 1:
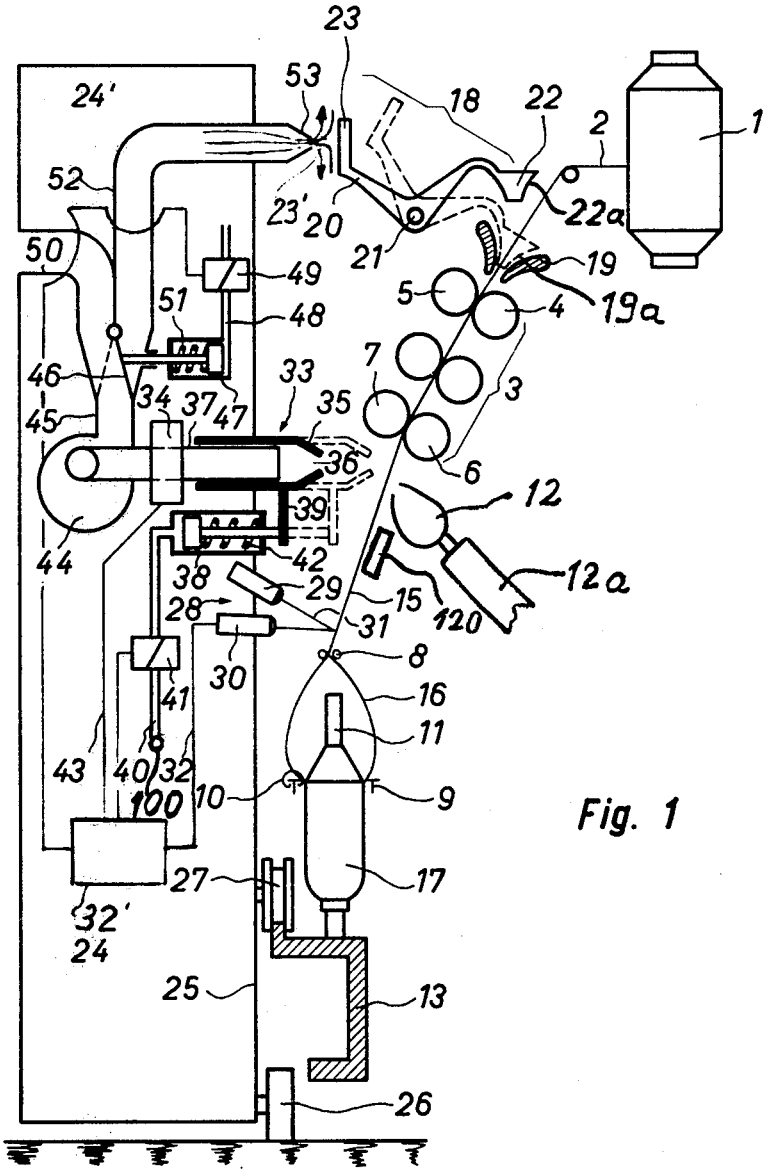
FIG. 1 is a schematic cross-sectional view of part of a ring spinning machine equipped with control apparatus constructed according to the teachings of the present invention and shown in its work position.

FIGS. *2a, 2b, 2c* and *2d* respectively schematically illustrate various operating conditions which are to be controlled or monitored at a spinning position of a ring spinning machine;

FIG. *3a* schematically illustrates in fragmentary sectional view a variant embodiment of the control or monitoring apparatus of FIG. 1; and FIG. *3b* illustrates in fragmentary cross-sectional view a further variant embodiment of the control or monitoring apparatus shown in FIG. 1.

DETAILED DESCRIPTION OF THE PREFERRED EMBODIMENTS

Describing now the drawings, it is to be understood that only enough of the ring spinning machine has been shown herein, in order to simplify the illustration of the drawings, and to enable those skilled in the art to readily understand the underlying principles and concepts of the present invention. Turning attention now to FIG. 1, there is shown therein a spinning position of a ring spinning machine and the same will be seen to essentially comprise a standard and therefore not further shown creel for a rotatably supported roving bobbin 1. The roving bobbin 1 supplies a fiber roving 2 to a drafting arrangement, generally indicated by reference character 3. This drafting arrangement 3 will be seen to comprise a pair of infeed or take-in rolls 4 and 5 and a pair of outfeed or delivery rolls 6 and 7. The spinning position will be seen to further comprise a yarn guide 8 and a combination of a ring 9, traveller 10 and spindle 11. At the exit side of the pair of delivery rolls 6 and 7 there is arranged a suction nozzle 12 of a conventional and therefore simply schematically indicated yarn suction device **12*a* which is connected continuously with a suitable and thus not particularly illustrated vacuum source. Hence, the yarn suction device 12*a* in conjunction with the nozzle 12** thereof exerts an active suction action at the related spinning location or position throughout the entire operating time of the machine.

The spindles 11 of all of the spinning positions which are arranged in a row are supported by a spindle rail 13 as is conventional in this technology. To simplify the illustration there has only been shown one of the spinning positions, but it will be apparent from the description to follow that each spinning position may be similarly constructed and the teachings of the invention entail the sequential monitoring and control of the operating conditions prevailing at each such spinning position.

Now during normal operation of any given spinning position of the aforedescribed type, the fiber roving 2 is withdrawn from the roving bobbin 1 by the rotation of the pair of infeed or input rolls 4 and 5. Within the drafting arrangement 3 the roving 2 is drafted, as required, in a manner such that there emerges from the pair of delivery rolls 6 and 7 a fine strand of fibers 14 (FIG. 2*b*) and which is caught and spun-in by the twist of the finished yarn 15 produced by rotation of the spindle 11 and imparted by means of the ring 9 coacting with the traveller or traveller ring 10. The finished yarn 15 passes through the yarn guide 8, and while there is formed a balloon 16, it is wound onto the yarn bobbin 17 during rotation of the spindle 11 by conventional means unimportant for understanding this invention and thus not here particularly further shown.

Now, the spinning position illustrated in FIG. 1 will be seen to additionally comprise a roving clamping device 18, the function of which is the controlled interruption of the infeed of the roving 2 to the drafting arrangement 3, as will be explained more fully hereinafter.

Continuing, a funnel 19 is rigidly mounted on the not particularly shown machine frame and through such funnel 19 there is guided the fiber roving 2. A double-arm lever 20 is pivotably supported at a pivot shaft or axle 21 which is also rigidly connected to the frame of the ring spinning machine supporting the working or operable elements of the spinning position. This double-arm lever 20 is provided at its righthand end, shown in the drawing of FIG. 1, with a conical extension 22. This conical extension or conical member 22, upon the lever 20 assuming the pivoted-in position shown in phantom lines in FIG. 1, contacts the inner surface 19*a* of the funnel 19 in a manner such that the roving 2 is clamped between this inner surface 19*a* and the outer surface 22*a* of such conical extension or member 22. At the other end of the double-arm lever 20 there is provided an impact or deflecting plate 23 for an air stream, generally indicated by reference character 23'. Now, if under normal operating conditions there is produced a yarn, then the lever 20 assumes the pivoted-up position shown in full lines in FIG. 1, where it is held by any suitable means, for instance, by way of example, by appropriately selecting its center of gravity. Now, when such double-arm lever 20 is pivoted into the above-discussed phantom line position of FIG. 1, the roving 2 which is clamped between the inner surface 19*a* of the funnel 19 and the outer surface 22*a* of the conical extension or member 22 is torn by the action of the pair of infeed or take-in rolls 4 and 5 which continue to rotate, the tearing of the roving 2 occurring at a location between the funnel 19 and the infeed rolls 4 and 5 of the drafting arrangement 3. Consequently, the further supply of roving 2 to the drafting arrangement 3 is interrupted.

The roving clamping device 18, here shown to be activated by the inflowing air stream 23' which impinges against the impact plate 23 or equivalent structure, is but one of many devices of this type which are known, and consitutes but one exemplary manner of reliably displacing the roving clamping plate 18. Obviously, the present invention is not intended to be limited to any specific type of roving clamping device or any specific technique for activating the same. It should be readily understood that, in fact, any type of roving clamping device which can be activated by a travelling control or monitoring apparatus can be beneficially combined with the invention herein described.

Now the control or monitoring apparatus, generally indicated by reference character 24, and which travels along the ring spinning machine, will be seen to comprise a suitable supporting structure 25 which is supported by means of the lower rolls 26 on the floor of the spinning mill or other area where the equipment is used and by means of the upper rolls 27 is supported upon the spindle rail 13. The upper rolls 27 serve to guide the control apparatus 24 in longitudinal direction along the ring spinning machine from one spinning location to the next spinning location and so forth. Of course, the control apparatus 24 also could be guided in a different way, for instance, it could be guided at its upper part 24' on the not particularly shown creel of the ring spinning machine, and the nature of the guiding system for the control apparatus 24 is of subordinate importance.

For the purpose of controlling or monitoring the operating conditions prevailing at the individual spinning positions the control or monitor apparatus 24 is provided with a yarn feeler 28. In the exemplary embodiment under discussion, this yarn feeler 28 may comprise a system of a light emitter 29 and a light receiver 30. The emitted light beam 31 of the light emitter 29 is reflected by the yarn 15 when it is present and is received by the light receiver 30. Now, if normal working conditions are present at the monitored spinning position, then the light receiver 30 merely transmits an appropriate signal via the circuit line 32 to a control device 32'.

Of course, the teachings of the invention are not limited in any way to a yarn detector 28 in the form of the indicated optical detector described by way of example herein and known as such to the art, but all known and suitable detecting methods, such as for instance, by using mechanical feelers, temperature feelers, travelling detectors and so forth, can be employed to advantage.

Equally, it is of no consequence where checking or control of the yarn is carried out along its path of travel or movement. Thus, it is perfectly acceptable to detect the yarn at the region of the balloon 16 or some other location.

Furthermore, it will be seen that the control apparatus 24 is provided with a fiber stream-deflecting device 33 which serves to deflect the fiber stream 54 (FIG. 2*b*) and to transfer the same to a fiber detector 34, as will be explained more fully hereinafter.

A suction tube 35 equipped with a suction nozzle 36 is arranged in telescopic fashion upon an inner tube 37. This suction tube 35 along with its suction nozzle 36 is movable essentially at right angles to the direction of movement of the control apparatus 24, i.e., also transversely with respect to the longitudinal direction of the ring spinning machine. In the embodiment shown, displacement of the suction tube 35 is accomplished by means of a pneumatic cylinder 38 connected with the suction tube 35 by means of a connecting rod 39. The pneumatic cylinder 38 is operatively connected by means of a duct 40 and a valve 41 with a suitable vacuum source, generally schematically indicated in FIG. 1 by reference character 100. This pneumatic cylinder 38 is here shown to be of the single-acting type and in its non-pressurized position, as shown in solid lines in FIG. 1, is retained at its rearmost stop or rearmost position by the action of a spring 42. In this position, corresponding to the idling position of the fiber stream-deflecting device 33, the suction nozzle 36 is located sufficiently far away from the ring spinning machine that it cannot exert any influence upon the operating conditions prevailing at the relevant spinning position.

Now, the fiber detector 34 is capable of detecting the presence of loose fibers in an air stream and of transmitting a corresponding signal via the electrical circuit line or conductor 43 to the control device 32'. By means of the suction tube 35 there is continuously sucked-in air, or at least during such time as the suction tube 35 is in its moved-out or extended position, shown in phantom lines in FIG. 1, and which position corresponds to the working position of the fiber stream-deflecting device 33, likewise shown in phantom lines in such FIG. 1. At this time the suction force exerted by the suction tube 35 exceeds the suction force exerted by the suction nozzle 12 of the yarn suction system or yarn suction device 12*a*. For this purpose the inner tube 37 is connected with a suitable vacuum source, such as the here exemplary illustrated fan 44. The exhaust air of the fan 44 or equivalent structure can be used for activating the pneumatically actuated roving clamping device 18. To that end, the exhaust air is guided through a tube or duct 45 containing a controllable baffle or flap valve 46 therein. The controllable baffle or flap valve 46 is controlled by means of a pneumatic cylinder 47 which can be controlled by the duct 48 and the control valve 49, so that the baffle or flap valve 46 or equivalent structure is held in either the position shown in full lines in FIG. 1, where the exhaust air flows freely via the exhaust tube or duct 50, if required through a suitable filter (not shown), to the surrounding room, or is moved into the phantom line position while overcoming the spring force of the spring 51 arranged within the pneumatic cylinder 47. Now, if the baffle 46 is in the phantom line position, then the exhaust air is guided through the tube or duct 52 to the outlet orifice 53 thereof which terminates immediately before and in the direct vicinity of the impact plate 23 of the roving clamping device 18. By the action of the air stream 23' emerging from the outlet orifice 53 and striking against the impact plate 23, the double-arm lever 20 is shifted from the full line position of FIG. 1 into the pivoted-in phantom line position, and, as described above, the supply of roving 2 to the drafting arrangement 3 of such spinning position is then interrupted.

Now, in order to further explain with greater clarity the function of the apparatus, there will be considered and described in conjunction with FIGS. 2*a* and 2*b*, 2*c* and 2*d*, different possible operating conditions which can prevail at any given spinning position or location of the ring spinning machine.

Figure 2A:
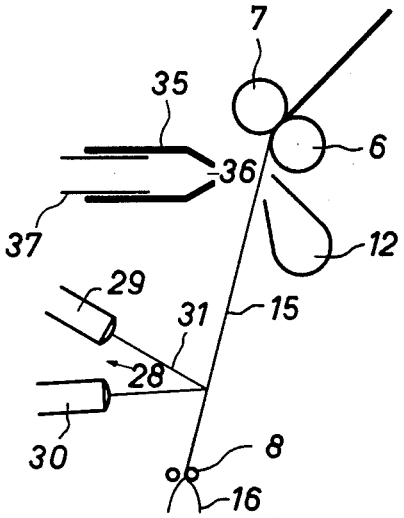

Now, in FIG. 2*a* there is schematically shown the spinning position when it is operating under normal operating conditions. The yarn 15 is spun in conventional fashion and extends in a taut condition from the pair of delivery rolls 6 and 7 of the drafting arrangement 3 to the yarn guide 8. If the few fibers which are not spun-in by the twist of the yarn, and which in terms of the quantity thereof can be neglected, are considered to be negligible, then no fibers are sucked-in by the suction nozzle 12. Control apparatus 24, only indicated in FIG. 2*a* to simplify the illustration by the main working elements 28 to 31 and 35 to 37, passes the spinning position and its yarn feeler 28 detects the presence of the yarn 15. The control or monitoring device 24 thus decides that at this particular spinning position normal operating conditions prevail and then continues to move on to the next spinning position. During this process the suction tube 35 remains in its retracted position, with the result that the suction action of the suction nozzle 36 is ineffectual at such spinning position.

Figure 2B:
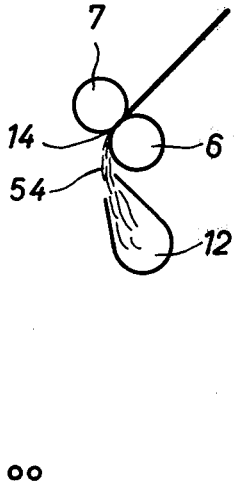

Now, in FIG. 2*b* there are shown conditions which prevail at a given spinning position when an end or yarn breakage has occurred and wherein the fibers which still emerge from the nip of the pair of delivery rolls 6 and 7 of the drafting arrangement 3 form a stream of fibers, hereinafter simply referred to as a fiber stream 54, which is no longer spun-in. This fiber stream 54 is eliminated by means of the suction nozzle 12 of the yarn suction device or system 12*a* in a manner conventional in this particular art.

Now, at this spinning position some good fiber material is of course guided into the yarn suction device or system 12*a*, but there does not exist any danger of damaging the working elements of the machine, i.e., there is not required any immediate intervention on the part of the operating personnel.

Figure 2C:
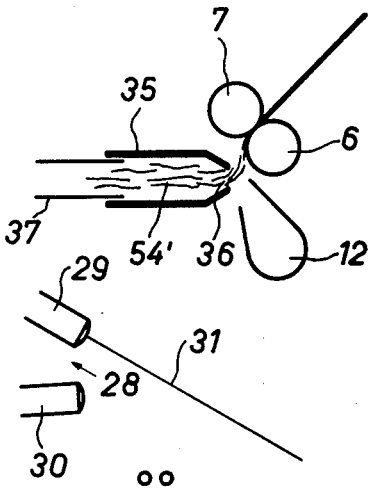

In FIG. 2*c* there is shown what happens following the arrival of the travelling control device 24 at a spinning position where there prevail the operating conditions described above with reference to FIG. 2*b*. The light receiver 30, due to the absence of any reflection of the emitted light beam, does not receive any reflected light beam 31. Now, in this case an appropriate signal indicative of this condition is transmitted by the electrical circuit line or conductor 32 to the control device 32' (FIG. 1). This signal activates the flow of compressed air by means of the valve 41 into the pneumatic cylinder 38. Thus, the fiber stream-deflecting device 33 is brought into its working position, i.e., the suction tube 35 is moved into its extended position, shown in phantom lines in FIG. 1. In this position the suction nozzle 36, as best seen by referring to FIG. 2*c*, is placed between the nip of the delivery roll 6 and 7 of the drafting arrangement 3 and the suction nozzle 12 of the yarn suction system 12*a*. Now, since the suction action of the suction nozzle 36 is greater than the suction action of the suction nozzle 12, the fiber stream 54 (FIG. 2*b*) is immediately deflected into the suction tube 35, i.e., away from the spinning position of the ring spinning machine and in the direction of the travelling control device 24. In FIG. 2*c* the deflected fiber stream has been generally designated by reference character 54'. The fibers of such fiber stream 54' which now flow within the suction tube 35 and in the inner tube 37 are detected by the fiber detector 34 of FIG. 1. By means of the circuit line or conductor 43 this fiber detector 34 then transmits a signal to the control device 32' (FIG. 1) which is then appropriately processed in accordance with the desired control operations. With the operating conditions as shown in FIG. 1, the control device 32', upon receiving both signals, via the circuit lines or conductors 32 and 43, by means of which the operating conditions at the spinning position according to FIG. 2*b* can be unmistakeably recognized, reaches the conclusion that no immediate danger of damage to the equipment prevails at this spinning position, and thus, transmits an appropriate signal to the control apparatus 24 to resume its travelling motion. The baffle or flap valve 46 then remains in the position indicated by full or solid lines and the roving supply therefore is not interrupted.

If, however, the control or monitoring apparatus 24 is equipped with further operating elements, only shown in FIG. 1 schematically, such as for instance, conventional elements or means 120 for piecing-up the broken yarn ends, it is possible to set the command sequence in such a manner that the control device 32' transmits the command signals to the above-mentioned operating elements or means so as to cause them to become operative and to perform the requisite control or operating action, for instance, the piecing of the broken yarn ends.

Figure 2D:
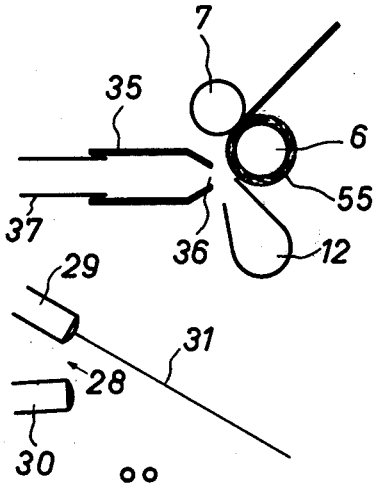

Finally, the most dangerous operating conditions, as exemplified in the showing of FIG. 2*d*, can occur at the spinning position. Here, the fibers emerging from the nip of the pair of delivery rolls 6 and 7 of the drafting arrangement 3, following the occurrence of yarn or end breakage, no longer are spun into a yarn 15 and are no longer sucked-in and eliminated by the suction nozzle 12 of the yarn suction device or system 12*a*. Rather, such emerging fibers tend to lap-up on the delivery roll 6 and form a lap-up 55. Formation of lap-ups on both delivery rolls 6 and 7 can occur. As experience has shown, this situation occurs relatively frequently after a yarn breakage has taken place at a spinning position and requires the performance of the requisite corrective action within the shortest time, otherwise the lap-up 55 continuously increases in size and eventually damages or even destroys the spinning position, for instance, by deforming the weighting arm of the drafting arrangement 3 or by bending the bottom delivery roll 6 and so forth. The very danger of formation of such lap-ups 55 up to the present time has required continuous surveillance of the ring spinning machine which, for instance, for the operating personnel working during the night shift, poses serious personnel problems. Fast and reliable detection of the working conditions prevailing as shown in FIG. 2*d* therefore is of primary importance, and it is to be remarked, can be advantageously guaranteed by the method described herein and the apparatus for the implementation thereof.

Now, as shown in FIG. 2*d*, even in the case of the formation of a lap-up 55, the yarn feeler 28 detects the absence of a yarn at the spinning position, and, as described with reference to FIG. 2*c*, the fiber stream-deflecting device 33 (FIG. 1) is immediately brought into its working position. Since here also no fiber stream 54 is present, no fiber stream is deflected into the suction tube 35. Hence, the fiber stream detector 34 (FIG. 1) does not transmit any signal to the control device 32'. If a signal is transmitted via the circuit line 32 and no signal is transmitted via the circuit line 43, then the control device 32' reaches the decision that a fiber lap-up 55 has formed and immediately initiates the corresponding control function and/or operating function. This function, for instance, as shown in FIG. 1, consists of the immediate stoppage of the supply of roving 2 to the drafting arrangement 3 by pivoting the roving clamping device 18 into the phantom line position of FIG. 1. Thus, further growth of the fiber lap-up 55 is beneficially prevented and the spinning position is accordingly protected against damage.

As will be apparent to one skilled in the art the electric circuits required for realizing the above-discussed control functions are well known to those acquainted with this technology, and therefore, need not here be further described since different control circuits, typically those using logic gates can be employed, and therefore do not require any further explanation.

It should be mentioned, however, that a similar situation can arise for the control apparatus 24, but without any danger as concerns the spinning position, if the reserve of fiber roving 2 which is creeled is exhausted or has already been interrupted. In this case, neither a yarn 15 nor a fiber stream 54, nor a fiber lap-up 55 are present. Also in this case the control apparatus 24 reacts as in the situation described above with reference to FIG. 2*d*, i.e., there is activated the roving clamping action, which however, for the assumed case, is ineffective. This action, however, is not totally futile, since the resulting position of the double-arm lever 20 visually flags or signals in a most easy manner to the patrolling monitoring or operating personnel the operating conditions which prevail at such spinning position.

Figure 3A:
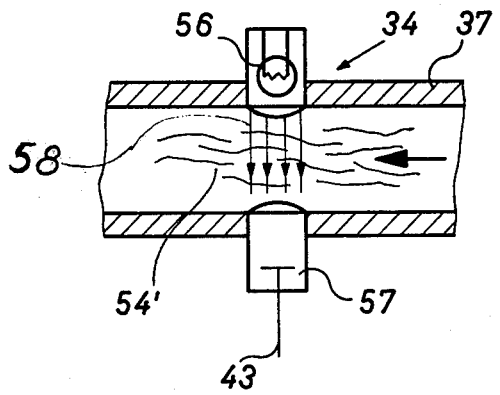
Figure 3B:
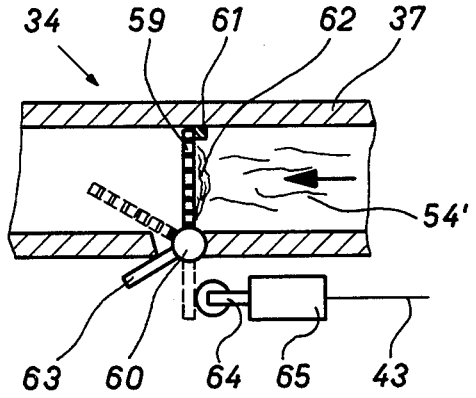

Finally, in FIGS. 3*a* and 3*b* there are shown two further respective embodiments of fiber detectors 34 which are known as such, but can be beneficially utilized within the teachings of the present invention.

According to the showing of FIG. 3*a*, the fiber detector 34 which is here installed or built into the inner tube 37 consists of a light barrier formed by a light emitter 56 and a light receiver 57. The fibers of the deflected fiber stream 54' which move through the tube 37 partially interrupt the light beam 58, schematically represented by the indicated arrows. The light receiver 57 is therefore obscured and transmits a corresponding control signal via the circuit line 43, which is accordingly evaluated in the control device 32' as constituting a signal representative of the presence of a deflected fiber stream 54'. The use of light barriers for similar purposes is well known and has proven itself in practice. They only are associated with the drawback that there is present a certain danger of contamination, so that in certain instances there are resorted to the use of different types of fiber detectors.

A fiber detector 34 which is less susceptible to the danger of contamination by the action of a fiber and air stream, has been shown in the modified arrangement of FIG. 3*b*. This fiber detector 34 comprises a grid or sieve type collecting shield or screen 59 which collects the fibers, but permits the passage of the air. The collecting shield 59 is pivotably hinged on a hinge or pivot 60 in the tube 37 and in its working position is pressed against a stop 61 by any suitable means, such as for instance, a spring, so that the entire cross-sectional area of the tube 37 is covered, Now, if a fiber stream 54' is deflected through the suction tube 35, the sucked-off fibers are deposited onto the collecting shield or screen 59 and at that location form a fiber layer 62. Thus, the air can only continue to flow through the tube 37 in the presence of the increased resistance, which ultimately results in tilting or pivoting of the collecting shield 59 into the position indicated with broken or phantom lines in FIG. 3*b*. During this operation an extension or projection 63 of the collecting shield 59 contacts an activation pin 64 of an electrical switch 65, which when activated, closes a contact and transmits an appropriate signal via the circuit line or conductor 43, this signal again being classified in the control device 32' as constituting a signal representative of the presence of a deflected fiber stream 54'.

The method described herein for controlling or monitoring the operating conditions on a ring spinning machine affords at least the following noteworthy advantages:

(a) The method is applicable at any ring spinning machine equipped with a yarn suction system, without requiring alterations or modifications at its spinning positions. Thus, it is most suitable also for realizing an automatic control at a large number of ring spinning machines which have already been installed.

(b) The method enables accomplishing an absolutely reliable control or monitoring of the operating conditions at each spinning position of a ring spinning machine. The sequence of the checking or monitoring operations is chosen such that properly functioning spinning positions are disturbed as little as possible by the control apparatus, since upon determination of the presence of the yarn there is dispensed with any further checking or monitoring operation.

(c) The results of the monitoring or control operations can be evaluated in any desired and sensible manner in accordance with the objectives of the control or monitoring operations, and thus, there can be realized various degrees of automation which range from merely clamping the roving in the event of lap-up formation on a delivery roll, by signalling or visually flagging the operating conditions at the relevant spinning position, to the fully automatic operation of the spinning position using an automatic yarn piecing device.

Furthermore, the proposed apparatus for implementing the inventive method affords a number of significant advantages, some of the more notable ones of which are the following:

(a) A simple and inexpensive construction, since the equipment for detecting the presence of a fiber lap-up on the delivery rolls is only required once as part of the control or monitoring apparatus.

(b) There is not required any precise guiding of the control apparatus along the ring spinning machine, since the employed control elements are not absolutely tied, as concerns their functional reliability, to an exact positioning thereof.

(c) Extremely reliable operation, without any disturbance of the operating conditions at spinning positions which are functioning properly.

(d) The apparatus can be easily mounted onto any ring spinning machine which has already been installed.

While there are shown and described present preferred embodiments of the invention, it is to be distinctly understood that the invention is not limited thereto, but may be otherwise variously embodied and practiced within the scope of the following claims.

Accordingly, what I claim is:

1. A method of consecutively controlling the operating conditions at a plurality of spinning positions of a ring spinning machine having a suction system, each spinning position having a drafting arrangement containing rolls and supplied with fiber material, a yarn being formed at each spinning position of the ring spinning machine, comprising the steps of:

detecting yarn breakages at each of the spinning positions and lap-up formations on the rolls of the drafting arrangement of each spinning position;

upon detection of a yarn breakage at a predetermined spinning position, deflecting the suction air stream of the suction system at such predetermined spinning position of the ring spinning machine; and checking said deflected suction air stream for the presence of a fiber stream.

2. The method as defined in claim 1, further including the step of:

accomplishing a control operation at one of the spinning positions upon detection of a fiber stream at said predetermined spinning position.

3. The method as defined in claim 2, further including the step of:

upon detection of a fiber stream carrying out a predetermined operating function prior to performing said control operation at said one of the spinning positions.

4. The method as defined in claim 3, wherein:

said predetermined operating function constitutes piecing-up the broken yarn.

5. The method as defined in claim 1, further including the step of:

upon detection of the absence of a fiber stream performing a first operating function.

6. The method as defined in claim 5, wherein:

said first operating function constitutes interrupting the supply of the fiber material to the drafting arrangement.

7. A method of consecutively controlling the operating conditions at a plurality of spinning positions of a ring spinning machine, each spinning position having applied thereto a suction air current and having a drafting arrangement containing rolls, a yarn being formed at each spinning position of the ring spinning machine, comprising the steps of:

detecting yarn breakages at each of the spinning positions and lap-up formations on the rolls of the drafting arrangement of each spinning position;

upon detection of a yarn breakage at a predetermined spinning position overpowering the suction air current at such predetermined spinning position of the ring spinning machine with a more powerful suction air current; and monitoring said predetermined spinning position for the presence of a fiber stream.

8. A control apparatus for consecutively controlling the operating conditions at a plurality of spinning positions each having a spindle of a ring spinning machine, each spinning position containing a yarn suction device and a drafting arrangement including a pair of cooperating infeed rolls and a pair of cooperating delivery rolls for drafting fiber material which is formed into a yarn, comprising:

said control apparatus embodying means enabling said control apparatus to travel from spinning position to spinning position along the ring spinning machine;

a yarn detector for detecting the presence of the yarn between the delivery rolls of the drafting arrangement and a spindle of the corresponding spinning position;

a fiber stream-deflecting device;

said yarn detector activating said fiber stream-deflecting device in the event of yarn breakage;

a fiber detector cooperating with said fiber stream-deflecting device;

said fiber stream-deflecting device taking-up the fiber stream acted on by the suction air stream of the suction system and transferring it to said fiber detector.

9. The control apparatus as defined in claim 8, wherein:

said fiber stream-deflecting device comprises a suction nozzle having a suction action upon the fiber stream which exceeds the suction action of the yarn suction device at the related spinning position.

10. The control apparatus as defined in claim 9, further including:

means for moving said suction nozzle from an idling position externally of a zone of action of the yarn suction device at the spinning position to a working position within the zone of action of the yarn suction device at such spinning position.

11. The control apparatus as defined in claim 8, further including:

means defining a vacuum source; and a connecting duct for connecting the vacuum source with the fiber stream-deflecting device.

12. The control apparatus as defined in claim 8, wherein:

said fiber detector comprises a light barrier responsive to the presence of loose fibers in an air stream.

13. The control apparatus as defined in claim 8, wherein:

said fiber detector comprises a collecting shield for loose fibers;

means defining a duct having a predetermined cross-sectional area;

said collecting shield being arranged within said duct so as to cover said cross-sectional area; and said collecting shield being structured such that with increased air flow resistance in the presence of a fiber stream the collecting shield initiates a switching function.

14. The control apparatus as defined in claim 8, wherein:

said control apparatus travels on the ring spinning machine;

each spinning position being provided with a roving clamping device activated by the fiber stream-deflecting device in the event of absence of a fiber stream.

15. The control apparatus as defined in claim 8, wherein:

said fiber stream-deflecting device comprises a telescoping structure.

16. The combination with a ring spinning machine having a plurality of spinning positions, each spinning position containing means applying at such spinning position a suction action, each spinning position including a drafting arrangement through which processed fiber material moves in a predetermined direction of travel, of a control apparatus for monitoring the operating conditions at such plurality of spinning positions by moving from spinning position to spinning position along the ring spinning machine during the monitoring of the operating conditions at each of the spinning positions, said control apparatus comprising:

means for sensing the presence of fiber material moving at each spinning position along said predetermined direction of travel;

a fiber stream-deflecting device;

means for moving said fiber stream-deflecting device from an inoperable position into an operable position adjacent the path of travel of the fiber material at the monitored spinning position for acting thereon on such fiber material while overcoming the suction action at such monitored spinning position in the event of breakage of the processed fiber material;

said sensing means being provided with structure for activating said fiber stream-deflecting device in the event of yarn breakage;

a fiber detector cooperating with said fiber stream-deflecting device;

said fiber stream-deflecting device acting upon the fiber material to render in-effectual the suction action upon said fiber material at the monitored spinning position and transferring the thus acted upon fiber material to said fiber detector.

* * * * *